US009865968B1

(12) United States Patent
Morello et al.

(10) Patent No.: US 9,865,968 B1
(45) Date of Patent: Jan. 9, 2018

(54) CONNECTOR HOUSING WITH AN INTEGRAL CONNECTOR POSITION ASSURANCE DEVICE

(71) Applicant: Delphi Technologies, Inc., Troy, MI (US)

(72) Inventors: John R. Morello, Warren, OH (US); James M. Rainey, Warren, OH (US); Gerald A. Rhinehard, Jr., Lordstown, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/414,693

(22) Filed: Jan. 25, 2017

(51) Int. Cl.

| | |
|---|---|
| ***H01R 3/00*** | (2006.01) |
| ***H01R 13/639*** | (2006.01) |
| ***H01R 43/18*** | (2006.01) |
| *H01R 13/641* | (2006.01) |

(52) U.S. Cl.
CPC ..... *H01R 13/639* (2013.01); *H01R 43/18* (2013.01); *H01R 13/641* (2013.01)

(58) Field of Classification Search
CPC ..... H01R 13/641
USPC ..... 439/489
See application file for complete search history.

(56) References Cited

U.S. PATENT DOCUMENTS

| | | | | |
|---|---|---|---|---|
| 5,980,318 | A | 11/1999 | Morello et al. | |
| 6,443,760 | B2 * | 9/2002 | Hasegawa | H01R 13/641 439/352 |
| 7,048,584 | B1 | 5/2006 | Morello et al. | |
| 8,747,146 | B2 * | 6/2014 | Brown | H01R 13/639 439/489 |
| 2006/0292928 | A1 | 12/2006 | Morello et al. | |

* cited by examiner

*Primary Examiner* — Tho D Ta
(74) *Attorney, Agent, or Firm* — Robert J. Myers

(57) ABSTRACT

A connector body configured to interconnect with a corresponding mating connector body includes a pair of longitudinal struts that extend from the connector body and are oriented substantially parallel to a mating axis of the connector body. The longitudinal struts each define an enclosed lateral slot having a closed end and a connector position assurance (CPA) device that is interlocked within the lateral slots and moveable from an initial position to a final position along the mating axis after the connector body is coupled to the corresponding mating connector body. The CPA device has a lateral cross bar extending into each of the lateral slots thereby retaining the cross bar in the lateral slots. The CPA device and the connector body are integrally formed by an additive manufacturing process.

11 Claims, 5 Drawing Sheets

CONNECTOR HOUSING WITH AN INTEGRAL CONNECTOR POSITION ASSURANCE DEVICE

TECHNICAL FIELD OF THE INVENTION

The invention generally relates to connectors, and more particularly relates to a connector housing with an integral connector position assurance device.

BACKGROUND OF THE INVENTION

In certain industrial applications, connectors, such as electrical connectors, are required to be securely connected to each other. These connectors are typically provided with locking features such as latches to lock the connector housings to each other. It is known to provide the connector assembly with a connector position assurance device (CPA) device, commonly referred to as a CPA device. A typical CPA device is supported on either the connector body or the connector housing for movement between an initial pre-locked position and a final locked position. The CPA device is secured in the initial position when the mating components are not fully assembled to one another. Once the mating components are fully assembled together, the CPA device can then be moved to the final position. Thus, the CPA device ensures a proper connection between the mating components before it can be moved to the final position. In the final position, the CPA device also prevents the mating components from being separated from one another. However, most CPA devices that accomplish these functions are generally complex in their structure and can be relatively difficult to operate between the initial and final positions. Thus, it would be desirable to provide an improved CPA device that is relatively simple in structure and easy to operate.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to an embodiment, a connector body configured to interconnect with a corresponding mating connector body in a connection system is presented. The connector body includes a pair of longitudinal struts extending from the connector body parallel to a mating axis each defining an enclosed lateral slot having a closed end and a connector position assurance (CPA) device interlocked within the lateral slots and moveable from an initial position to a final position along the mating axis after the connector body is coupled to the corresponding mating connector body. The CPA device has a lateral cross bar extending into each of the lateral slots thereby retaining the cross bar in the lateral slots. The CPA device and the second connector body are integrally formed by an additive manufacturing process.

The additive manufacturing process may be one of the following processes: stereolithography (SLA), digital light processing (DLP), fused deposition modeling (FDM), fused filament fabrication (FFF), selective laser sintering (SLS), selecting heat sintering (SHS), multi-jet modeling (MJM), and 3D printing (3DP).

Each of the lateral slots may extend through the longitudinal strut. The lateral slots may have two closed ends.

The lateral cross bar may extend through each of the lateral slots and define retaining features outboard of each of the pair of longitudinal struts. The retaining features are configured to prevent removal of the cross bar from the lateral slots. The retaining features may be joined to one another and the retaining features and the cross bar may form a closed loop that surrounds the connector body along the mating axis. Alternatively, the retaining features may be retaining beams that are substantially parallel to the pair of longitudinal struts. A cross section of the retaining beam and the cross bar may form an L-shape or a T-shape.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

In these figures, reference numbers having the same last two digits are used to designate identical or similar elements in the various embodiments.

DETAILED DESCRIPTION OF THE INVENTION

The connector body described herein includes a primary locking system made up of a primary latch and primary striker that, when engaged, inhibit the connector body from being inadvertently separated from a corresponding mating connector body. The connector body further includes a connector position assurance (CPA) device that is essentially a secondary locking system. The CPA device is designed so that it can be moved from an initial position to a final position that inhibits disengagement of the primary locking system. The CPA further verifies that the connector body and corresponding mating connector body are fully mated, since it cannot be moved to the final position until they are fully mated.

In the following description, terms describing orientation such as "longitudinal" will refer to the mating axis X while "lateral" should be understood to refer to an axis perpendicular to the mating axis X, which is not necessarily the transverse axis. Furthermore, other terms such as "top" or "bottom" should be understood relative to an axis perpendicular to the mating axis X, which is not necessarily the vertical axis. As used herein the terms "front" and "forward" refer to a lateral orientation referenced from the connector body towards the corresponding mating connector body and the terms "back", "rear", "rearward", and "behind" refer to a lateral orientation referenced from the corresponding mating connector body towards the connector body.

Figure 1:
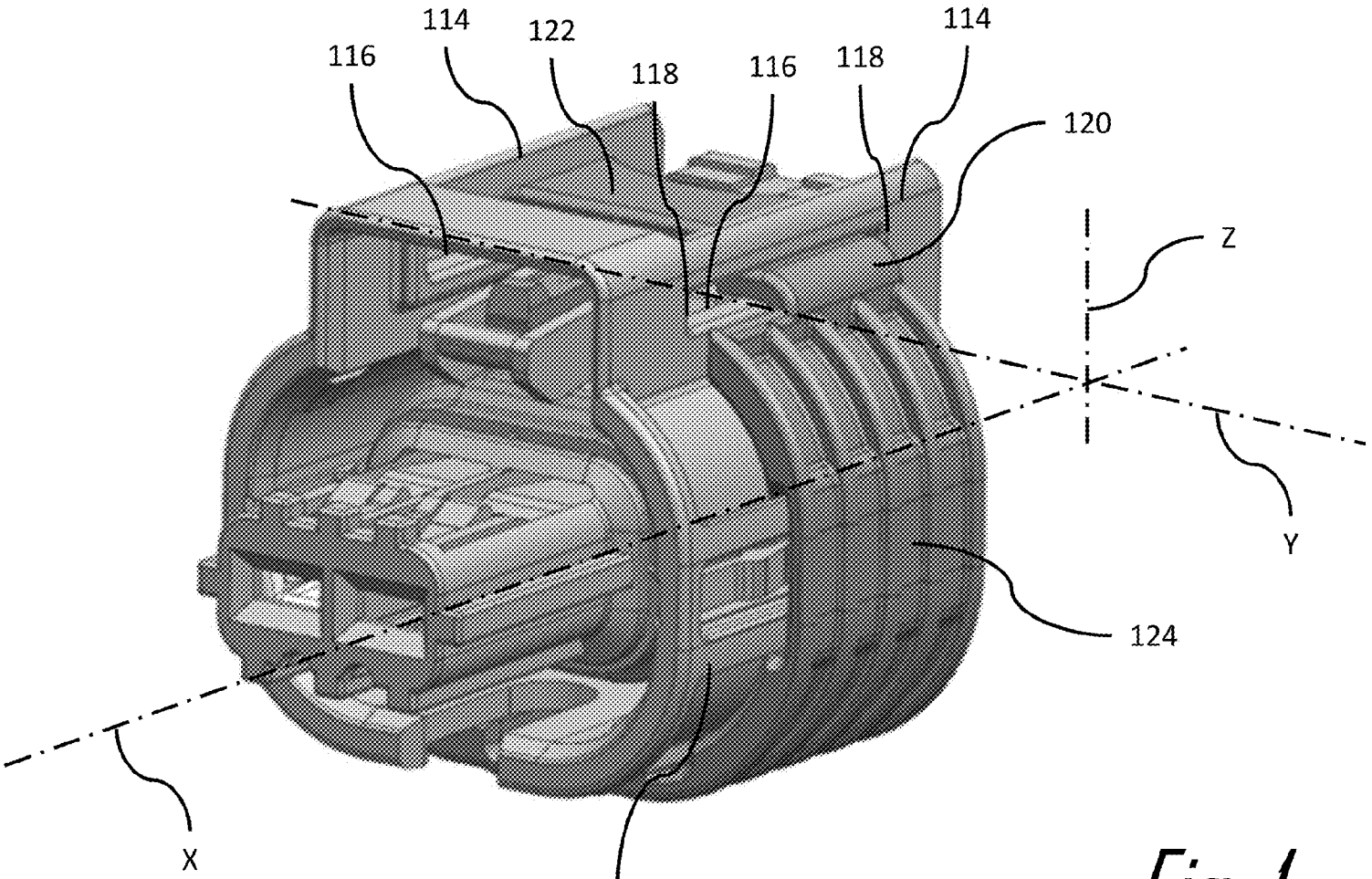
FIG. 1 is a perspective view of a connector body configured to interconnect with a corresponding mating connector body in accordance with one embodiment.
Figure 2:
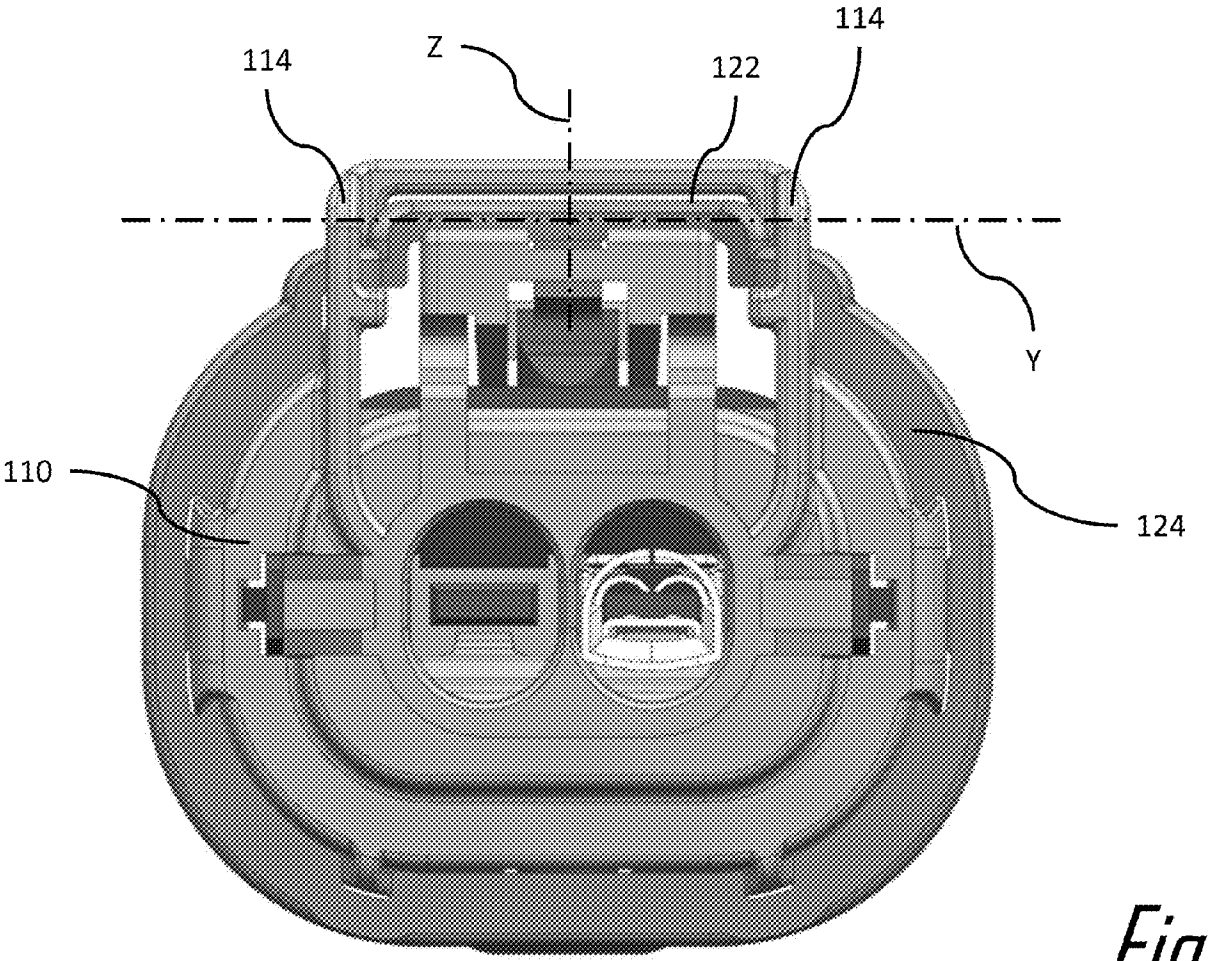
FIG. 2 is a rear view of the connector body of FIG. 1 in accordance with one embodiment.

A non-limiting example of connector body configured to interconnect with a corresponding mating connector body is illustrated in FIGS. 1 and 2. The connector body, hereinafter referred to as the first connector 110, is configured to interconnect with a corresponding mating connector body, hereinafter referred to as the second connector (not shown). The first connector 110 illustrated here is an electrical connector configured to join electrical wires. The first connector 110 and the second connector each contain electrical terminals (not shown) attached to electrical wires (not shown) that are designed to interface and connect with corresponding terminals (not shown) in the second connector. While the first connector 110 illustrated here is configured to interconnect a plurality of wire pairs, alternative embodiments of the connector assembly may connect only a single wire pair. Alternative embodiments of the connector assembly may be used to interconnect other types of conductors, such as fiber optic cables, fluid carrying lines, pneumatic tubing, or a combination of any of these.

The first connector 110 includes a pair of longitudinal struts 114 that extend from the first connector 110 from a top surface of the first connector 110 in a vertical direction Z and are oriented substantially parallel to a mating axis X of the first connector 110. Each longitudinal strut 114 defines an enclosed lateral slot 116 extending in a lateral direction Y therethrough. The lateral slots 116 have two closed ends 118. The first connector 110 further includes a connector position assurance (CPA) device 120 that is interlocked within each of the lateral slots 116. The CPA device 120 is moveable from an initial position to a final position along the mating axis X after the first connector 110 is coupled to the second connector. The CPA device 120 includes a lateral cross bar 122 that extends through each of the lateral slots 116. The cross bar 122 is connected to a retaining loop 124 outboard of each of the pair of longitudinal struts 114. The retaining loop 124 forms a closed loop that surrounds the first connector 110 along the mating axis X. This retaining loop 124 is configured to prevent removal of the cross bar 122 from the lateral slots 116 and thereby prevent the CPA device 120 from being separated from the first connector 110. The retaining loop 124 is also configured to allow an operator to grasp the retaining loop 124 as the first connector 110 is mated with the second connector.

Without subscribing to any particular theory of operation, the CPA device 120 will remain in the initial position as force applied by the operator to the retaining loop 124 moves the first connector 110 relative to with the second connector until the first connector 110 and the second connector are fully mated and the primary locking system (not shown) engages. After that point, force applied by the operator to the retaining loop 124 will move the CPA device 120 from the initial position to the final position, thereby in inhibiting disengagement of the primary locking system.

Figure 3:
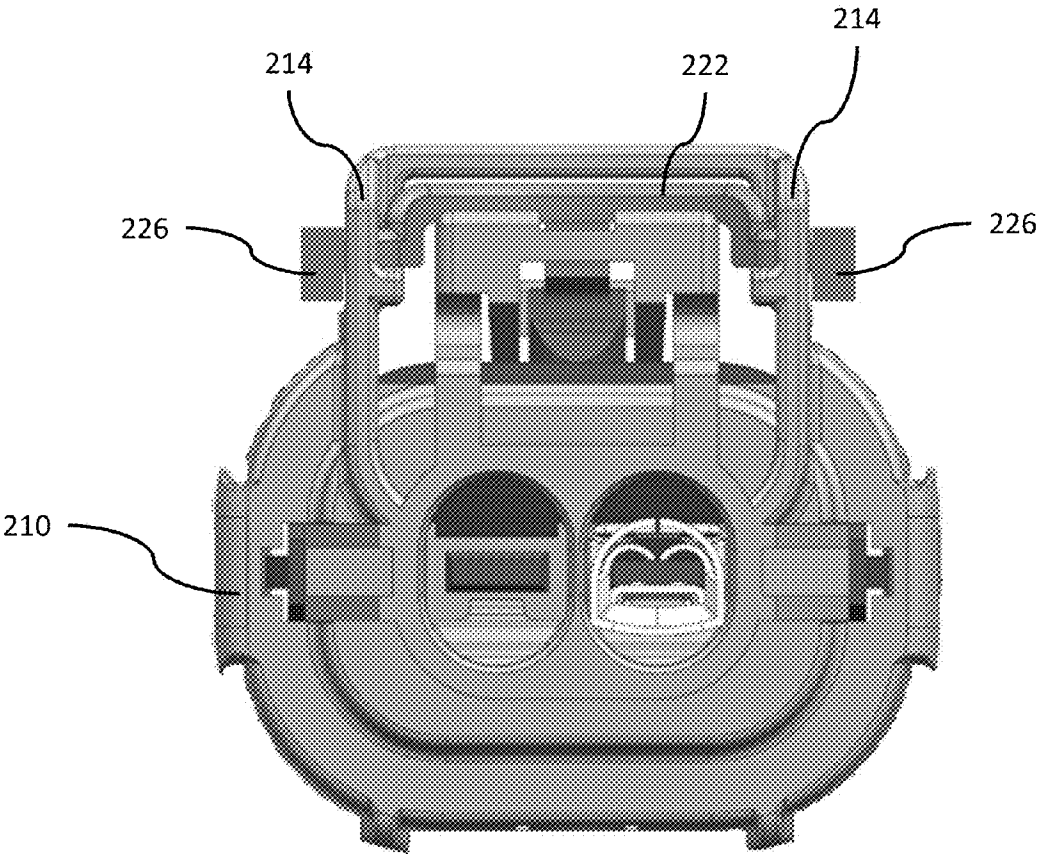
FIG. 3 is a rear view of a connector body configured to interconnect with a corresponding mating connector body in accordance with another embodiment.
Figure 4:
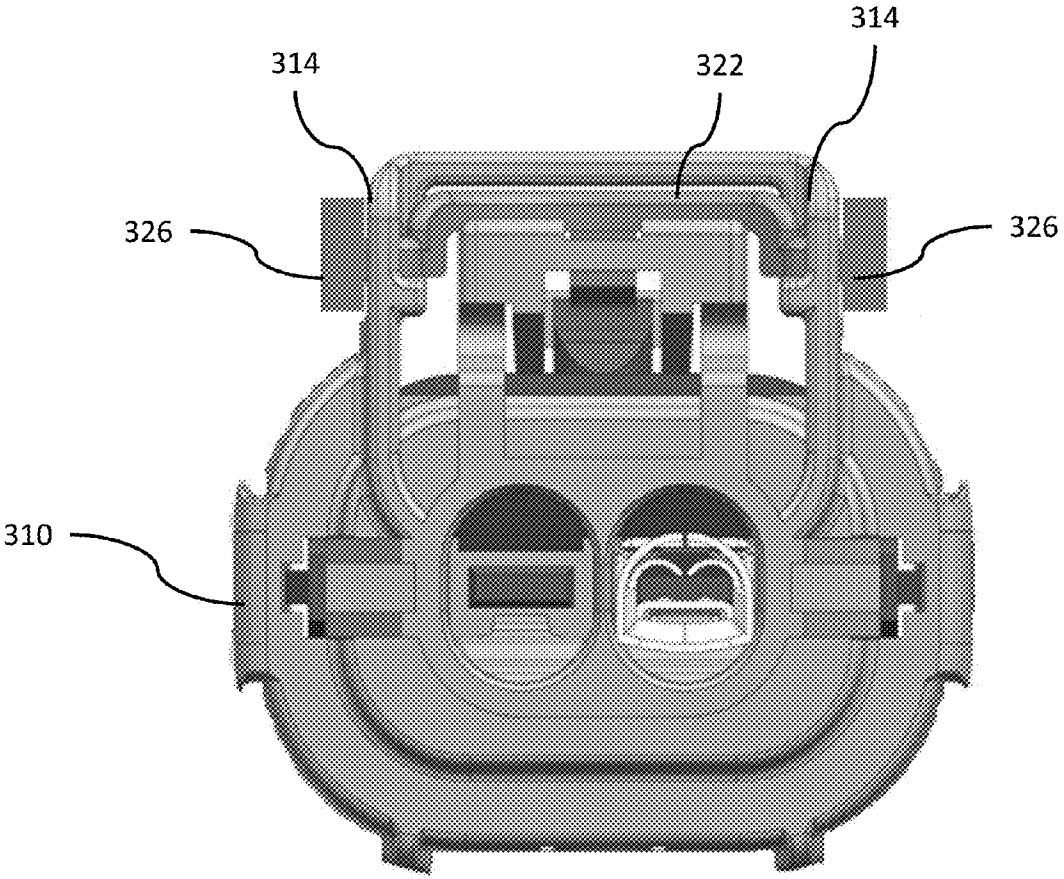
FIG. 4 is a rear view of a connector body configured to interconnect with a corresponding mating connector body in accordance with yet another embodiment.

Alternative embodiments of the first connector 210, 310 are illustrated in FIGS. 3 and 4. Rather than having a retaining loop as in the embodiment shown in FIGS. 1 and 2, the CPA devices 220, 320 have retaining beams 226, 326 outboard of the longitudinal struts 214, 314 that are substantially parallel to the pair of longitudinal struts 214, 314. A cross section of the retaining beam 226 and the cross bar 222 form an L-shape as shown in FIG. 3 or the cross section of the retaining beam 326 and the cross bar 322 form a T-shape as shown in FIG. 4. These retaining beams 226, 326 prevent the CPA device from being removed from the lateral slots.

Figure 5:
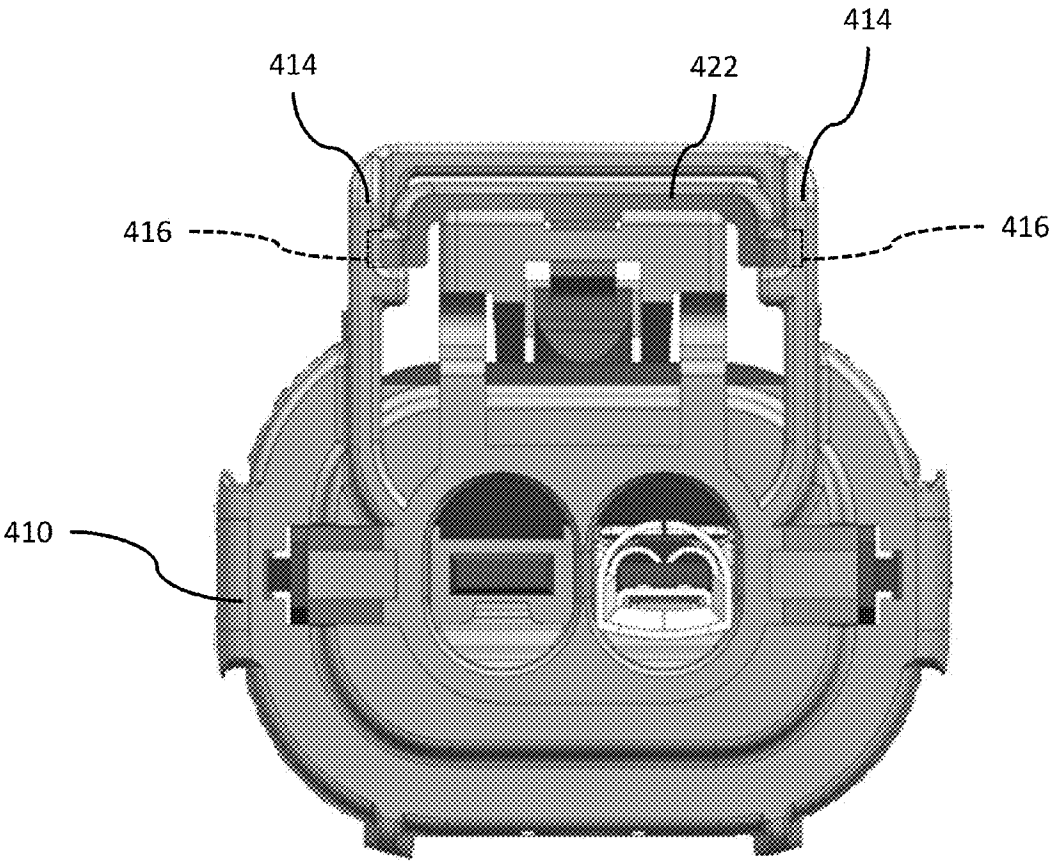
FIG. 5 is a rear view of a connector body configured to interconnect with a corresponding mating connector body in accordance with yet another embodiment.

Yet another alternative embodiment of the first connector 410 is illustrated in FIG. 5. According to this embodiment, the lateral slots 416 do not pass through the longitudinal struts. The cross bar 422 extends into each of the lateral slots 416 thereby retaining the cross bar 422 in the lateral slots 416.

In each of the preceding embodiments, the CPA device and the first connector are integrally formed so that they are one single piece. The CPA device and the first connector are integrally formed of a dielectric polymeric material by an additive manufacturing process, such as stereolithography (SLA), digital light processing (DLP), fused deposition modeling (FDM), fused filament fabrication (FFF), selective laser sintering (SLS), selecting heat sintering (SHS), multi-jet modeling (MJM), and 3D printing (3DP) or any other additive manufacturing proves suitable for forming parts from a polymer material.

Accordingly, an electrical connection system having a first connector configured to interconnect with a second connector is provided. A CPA device is formed integrally with the first connector and does not need to be joined to the first connector in a separate assembly step and may be formed in the initial position, thereby eliminating the need to place it in the initial position. Also because the CPA device is formed integrally with the first connector, the CPA device does not require flexible retaining features in order to secure the CPA device to the first connector since it is captured in the lateral slots, thereby simplifying the design of the CPA device and the first connector. Integrally forming the CPA device and first connector may provide less dimensional variation and lower manufacturing tolerances than parts formed by conventional plastic molding. Integrally forming the CPA and first connector would be extremely difficulty using conventional plastic molding techniques.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A connector body configured to interconnect with a corresponding mating connector body, comprising:

a pair of longitudinal struts extending from the connector body parallel to a mating axis each defining an enclosed lateral slot having two closed ends; and a connector position assurance (CPA) device interlocked within the lateral slots and moveable along the mating axis after the connector body is coupled to the corresponding mating connector body, said CPA device having a lateral cross bar extending through each of the lateral slots, wherein the lateral cross bar defines retaining beams outboard of each of the pair of longitudinal struts that are substantially perpendicular to the lateral cross bar.

2. The connector body according to claim 1, wherein the retaining beams are substantially parallel to the pair of longitudinal struts.

3. The connector body according to claim 1, wherein a cross section of the retaining beam and the cross bar form an L-shape.

4. The connector body according to claim 1, wherein the cross section of the retaining beam and the cross bar form a T-shape.

5. The connector body according to claim 1, wherein the retaining beams are configured to prevent removal of the lateral cross bar from the lateral slots.

6. The connector body according to claim 1, wherein the CPA device and the connector body are integrally formed by an additive manufacturing process.

7. The connector body according to claim 6, wherein the additive manufacturing process is selected from a list consisting of stereolithography (SLA), digital light processing (DLP), fused deposition modeling (FDM), fused filament fabrication (FFF), selective laser sintering (SLS), selecting heat sintering (SHS), multi-jet modeling (MJM), and 3D printing (3DP).

8. A connector body configured to interconnect with a corresponding mating connector body, comprising:

a pair of longitudinal struts extending from the connector body parallel to a mating axis each defining an enclosed lateral slot having a closed end; and a connector position assurance (CPA) device interlocked within the lateral slots and moveable along the mating axis after the connector body is coupled to the corresponding mating connector body, wherein each lateral slot extends through the longitudinal strut, wherein each lateral slot has two closed ends, said CPA device having a lateral cross bar extending into each of the lateral slots thereby retaining the cross bar in the lateral slots, wherein the lateral cross bar extends through each of the lateral slots and defines retaining features outboard of each of the pair of longitudinal struts and wherein the retaining features and the lateral cross bar form a closed loop that surrounds the connector body along the mating axis.

9. The connector body according to claim 8, wherein the closed loop is configured to prevent removal of the lateral cross bar from the lateral slots.

10. The connector body according to claim 8, wherein the CPA device and the connector body are integrally formed by an additive manufacturing process.

11. The connector body according to claim 10, wherein the additive manufacturing process is selected from a list consisting of stereolithography (SLA), digital light processing (DLP), fused deposition modeling (FDM), fused filament fabrication (FFF), selective laser sintering (SLS), selecting heat sintering (SHS), multi-jet modeling (MJM), and 3D printing (3DP).

* * * * *